United States Patent [19]

Taga

[11] Patent Number: 4,645,110

[45] Date of Patent: Feb. 24, 1987

[54] DRIVE CONTROL IN AN APPARATUS FOR ASSEMBLING FASTENER ELEMENTS

[75] Inventor: Yukio Taga, Uozu, Japan

[73] Assignee: Nippon Notion Kogyo Co., Ltd., Tokyo, Japan

[21] Appl. No.: 766,989

[22] Filed: Aug. 19, 1985

[30] Foreign Application Priority Data

Aug. 30, 1984 [JP] Japan ..... 59-132040[U]

[51] Int. Cl.[4] ..... A41H 37/00; A41H 37/10; B21J 13/00

[52] U.S. Cl. ..... 227/2; 227/15

[58] Field of Search ..... 227/15, 18, 8, 149, 227/2, 142

[56] References Cited

U.S. PATENT DOCUMENTS 3,117,690 1/1964 Anderson ..... 227/149

FOREIGN PATENT DOCUMENTS 2120813 12/1983 United Kingdom ..... 227/2

*Primary Examiner*—Robert L. Spruill

*Assistant Examiner*—Taylor J. Ross

*Attorney, Agent, or Firm*—Hill, Van Santen, Steadman & Simpson

[57] ABSTRACT

In a garment-fastener-assembling apparatus, a drive mechanism for moving an upper or punch unit toward and away from a lower or die unit includes an air cylinder having a piston rod, and a toggle joint for transferring reciprocating motion from the piston rod to a punch of the upper unit as the toggle joint is contracted and extended. A contact member is mounted on the toggle joint so as to actuate a limit switch when the toggle joint is fully extended to a predetermined extent. The limit switch, upon actuation, produces an electrical signal for de-energizing the air cylinder to terminate the extension of the piston rod.

2 Claims, 9 Drawing Figures

DRIVE CONTROL IN AN APPARATUS FOR ASSEMBLING FASTENER ELEMENTS

BACKGROUND OF THE INVENTION

1. Field of the Invention

The present invention relates to an apparatus for assembling a pair of fastener elements of a garment fastener, such as a snap fastener, a button or an ornament, with a garment fabric disposed between the two fastener elements.

2. Prior Art

Various fastener-assembling apparatus are known in which a pair of fastener elements of a garment fastener is supported on a lower or die unit and an upper or punch unit, respectively; a punch of the upper unit moves toward a die of the lower unit to join the two fastener elements together in clinched condition, with a garment fabric sandwiched between the two fastener elements. In most of the known apparatus, a drive mechanism for moving the punch vertically includes an air cylinder having a reciprocable piston rod, and a toggle joint for transferring reciprocating motion from the piston rod to the punch. As the piston rod reciprocates, the toggle joint is movable between a contracted position in which two levers are angled to each other, and an extended position in which the two levers are verticaly aligned. A common problem with the apparatus of this type is that if there is play in joints between the piston rod, the levers and the punch, or if there is any flash or fin on the punch or on an associated part along which the punch reciprocates, the toggle joint cannot be fully extended to a required extent even though the amount of extension of the piston rod is adjusted or set precisely. As a consequence, the punch would often fail to reach a predetermined lower level in which the button and the tack are to be sufficiently compressed between the punch and the die.

SUMMARY OF THE INVENTION

In a fastener-assembling apparatus according to the present invention, a drive mechanism for moving an upper or punch unit toward and away from a lower or die unit includes an air cylinder having a piston rod, and a toggle joint for transferring reciprocating motion from the piston rod to a punch of the upper unit as the toggle joint is contracted and extended. A contact member is mounted on the toggle joint so as to actuate a limit switch when the toggle joint is fully extended to a predetermined extent. The limit switch, upon actuation, produces an electrical signal for de-energizing the air cylinder to terminate the extension of the piston rod.

It is therefore an object of the present invention to provide an apparatus for assembling a pair of fastener elements of a garment fastener, in which a punch can be lowered to a predetermined level reliably so that the two fastener elements are compressed between the punch and a die sufficiently.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
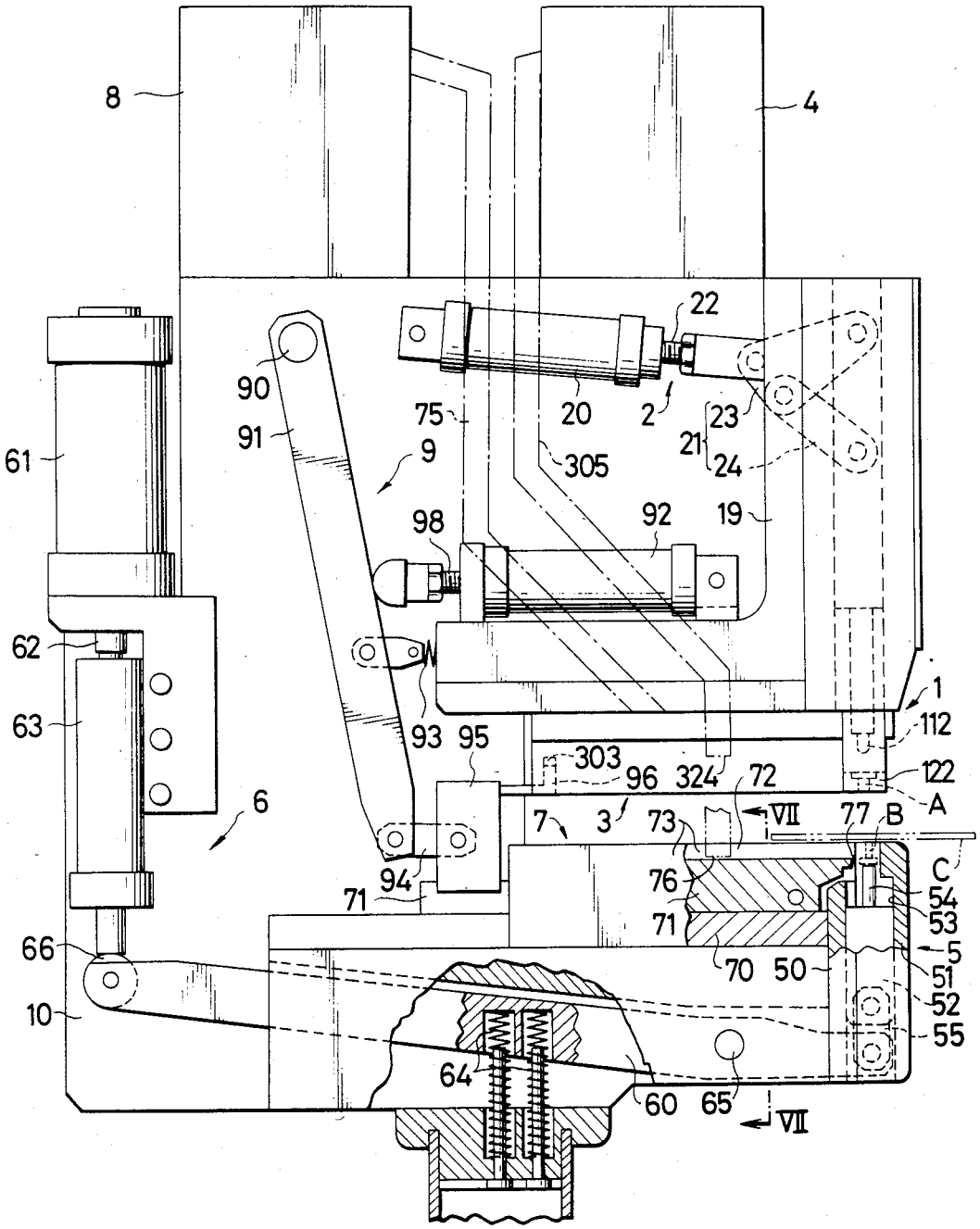
FIG. 1 is a side elevational view, with parts broken away, of an apparatus embodying the present invention.
Figure 9:
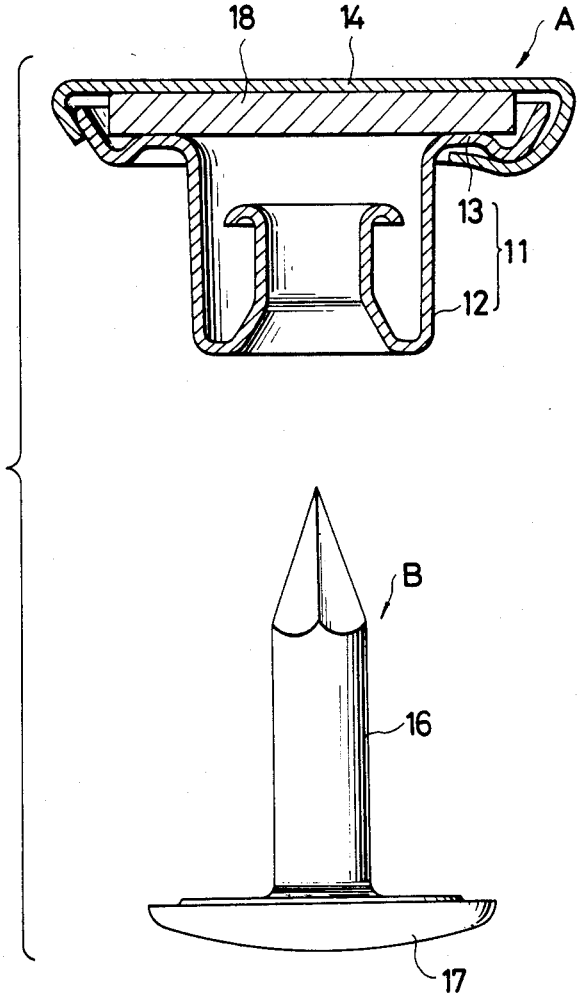
FIG. 9 is a front elevational view, partly in cross section, of a pair of fastener elements to be joined together by the apparatus according to the present invention.

FIG. 1 shows an apparatus for joining a pair of first and second fastener elements A, B (illustrated in phantom lines) together, with a garment fabric C (illustrated in phantom lines) disposed therebetween. In the illustrated embodiment, the first and second fastener elements A, B comprise a button and a tack, respectively. As best shown in FIG. 9, the button A includes a button back 11 which has an annular rim 13 covered by a cap 14. A circular back plate 18 is disposed between the button back 11 and the cap 14. The button back 11 also has a hollow shank 12 in the form of a double tube projecting centrally from an inner edge of the annular rim 13. The tack B has a disk-like head 17 and a spike 16 projecting centrally therefrom for piercing through the garment fabric C (FIG. 1) and also for being inserted through the hollow shank 12 of the button back 11.

The apparatus comprises an upper or punch unit 1, a first drive mechanism 2 for vertically moving a punch 112 of the upper unit 1, and a first pusher mechanism 3 for receiving a button A from a first feeder 4 and for supplying the button A to the upper unit 1. The apparatus also comprises a lower or die unit 5, a second drive mechanism 6 for vertically moving a die 54 of the lower unit 5, and a second pusher mechanism 7 for receiving a tack B from a second feeder 8 and for supplying the tack B to the lower unit 5. The first and second pusher mechanisms 3, 7 are driven in timed relation to each other by a third drive mechanism 9.

Figure 2:
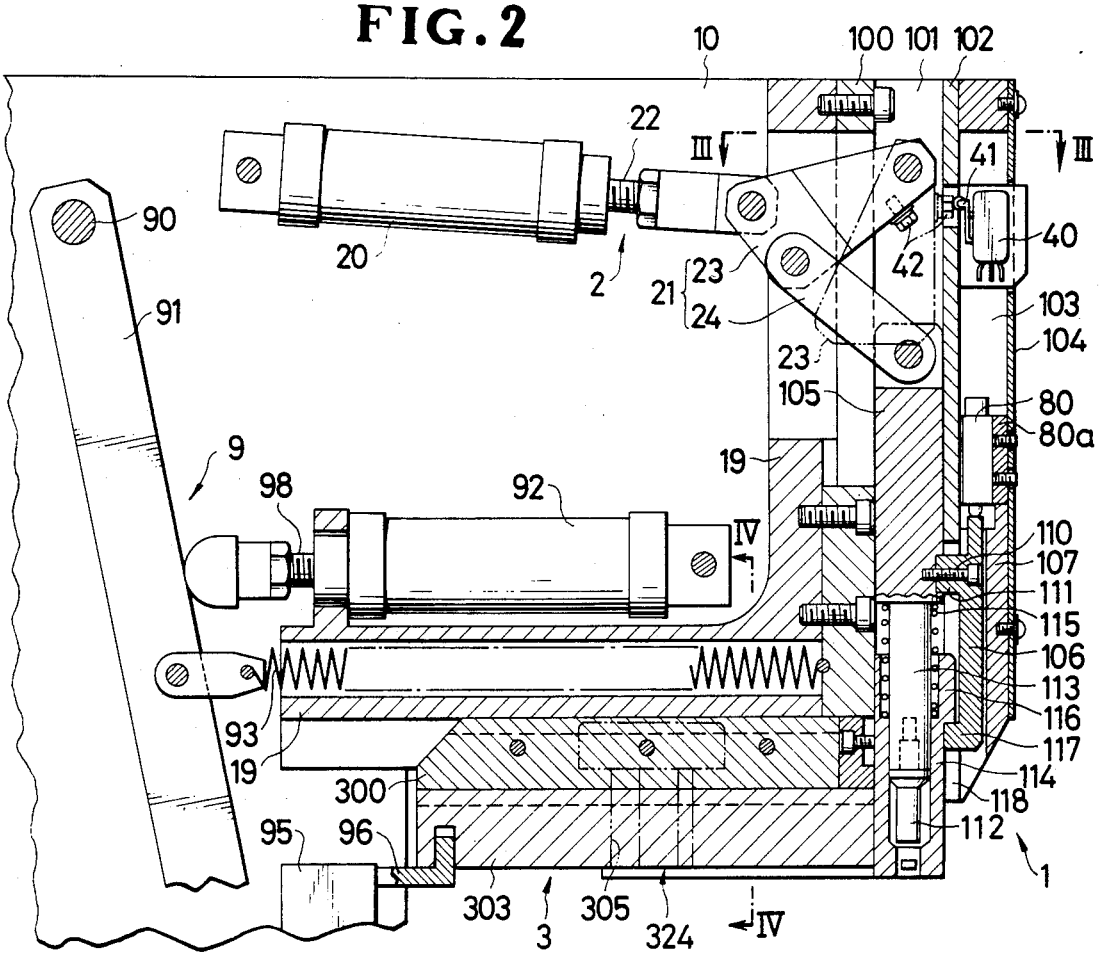
FIG. 2 is a fragmentary enlarged cross-sectional view of FIG. 1, showing an upper unit, a first drive mechanism and a first pusher mechanism.

As best shown in FIG. 2, the upper unit 1 includes a guide 100 fixed to a support 19 and having a first vertical channel 101, and an upper plunger 105 reciprocable vertically within the first vertical channel 101 in the intermediate plate 102, an intermediate plate 102 attached to the guide 100 at its front side, a cover plate 104 attached to the guide 100 and defining a second vertical channel 103 with the intermediate plate 102 and a pair of opposite side members 108, 108 of the guide 100, and a slide guide 107 of generally C-shaped cross section extending vertically in a lower portion of the second vertical channel 103 and fixed to the side members 108, 108 (FIG. 3) of the guide 100. The support 19 is fixed to the guide 100 by means of a pair of screws (not numbered). As shown in FIGS. 2 and 4, a slide 106 is vertically slidably received between a pair of spaced vertical flanges 109, 109 of the slide guide 107. The slide 106 is fixed to the plunger 105 by means of a screw 110 extending through a leftwardly directed projection 111 into the plunger 105 which projection extends through a vertical slot 118 in the intermediate plate 102.

The plunger 105 is operatively connected at its upper end to the first drive mechanism 2 for vertical reciprocating movements toward and away from the lower unit 5. At its lower end, the plunger 105 has a coaxial head 113 vertically slidably supported by a first support block 114 which is in turn vertically slidably received in the first vertical channel 101 in the guide 100. A compression spring 115 extends around the plunger head 113 and acts between the plunger 105 and the support block 114 to normally urge the latter downwardly away from the plunger 105. The downward movement of the support block 114 is restricted by a hook portion 117 of the slide 106; the hook portion 117 projects into the slot 118 in the guide 100 and is engageable with a lateral projection 116 extending from an upper end of the support block 114 into the slot 118. The punch 112 is fixed to the lower end of the plunger head 113.

As shown in FIG. 4, the support block 114 has in its lower end a pair of vertical slits 121, 121 in which a pair of clamp members 122, 122 is pivotally mounted, respectively. A pair of wireform springs 124, 124 is supported on the support block 114 and acts on the clamp members 122, 122 to normally urge the latter toward each other for clamping a button A therebetween. When a button A is supplied into the space between the clamp members 122, 122 by the first pusher mechanism 3, the cap 14 of the button A pushes the clamp members 122, 122 away from each other against the bias of the springs 124, 124 until the button A is placed between the clamp members 122, 122. The button A thus clamped between the clamp members 122, 122 is lowered by the first drive mechanism 2 to a lower position where the button A is joined with a mating tack B by the die 54 and the punch 112.

The first drive mechanism 2, as shown in FIGS. 1 and 2, includes an air cylinder 20 and a toggle joint 21 composed of a pair of first and second levers 23, 24, the air cylinder 20 being pivotally supported on the frame 10. The first lever 23 is pivotally secured at one end thereof to the guide 100 and is pivotally connected at the other end to a piston rod 22 of the air cylinder 20, while the second lever 24 is pivotally connected at opposite ends to the first lever 23 and the plunger 105. In response to reciprocating movement of the piston rod 22, the first and second levers 23, 24 are pivotally moved relative to each other between a contracted position in which the two levers 23, 24 are disposed substantially at a right angle to one another, and an extended position in which the two levers 23, 24 are disposed substantially in a vertical straight line. Thus as the two levers 23, 24 are moved between the contracted and extended positions, the plunger 105 is moved vertically.

A limit or detector switch 40 (FIGS. 2, 3, 4) is mounted in an upper portion of the second vertical channel 103 and has an actuator 41 which projects into an opening in the intermediate plate 102 for being depressed by a contact member 42 mounted on an edge of the first lever 23 when the latter assumes the substantially vertical position (phantom lines in FIG. 2). Upon depression of the actuator 41, the limit switch 40 is actuated to produce a signal for de-energizing the air cylinder 20 so as to.terminate the extension of the piston rod 22, thus restricting the forward or rightward movement of the first and second levers 23, 24. As a consequence, the downward or advance movement of the plunger 105 and thus of the slide 106 is restricted.

The contact member 42 comprises a screw threadedly mounted on the first lever 23 so as to project from the edge of the first lever 23. The extent to which the contact member 42 projects beyond the edge of the first lever 23 can be varied by turning the contact member 42. Thus the maximum amount of extension of the piston rod 22 can be adjusted.

Figure 8:
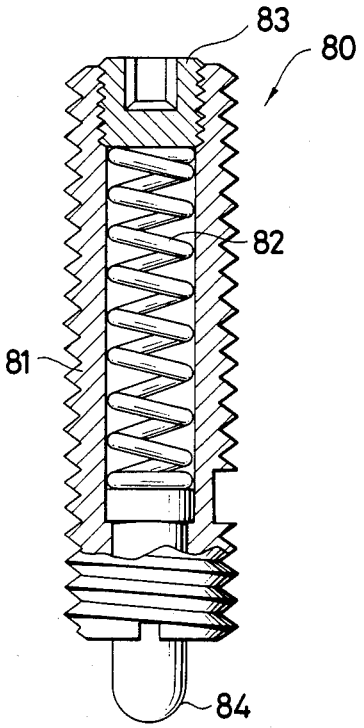
FIG. 8 is a cross-sectional view of a stop.

The upward or return movement of the upper plunger 105 and thus of the slide 106 is restricted by a stop 80 (FIGS. 2, 4, 8) which is mounted in the second vertical channel 103 above the slide 106. As best shown in FIG. 8, the stop 80 comprises a tube 81 threadedly extending through a supporting block **80*a* (FIGS. 2 and 4), a slide member 84 telescopically received in the tube 81 and projecting from the lower end of the tube 81, and a compression spring 82 disposed in the tube 81 and acting between the tube 81 and the slide member 84 to normally urge the latter downwardly. A closure 83 is threadedly fitted in the upper end of the tube 81 to prevent the compression spring 82 from being removed from the tube 81. The compression spring 82 serves to absorb shocks caused as the slide member 84 is struck by the slide.106 at the end of the upward stroke thereof. Alternatively, the compression spring 82** may be replaced with other resilient member such as of elastomeric material.

Figure 5:
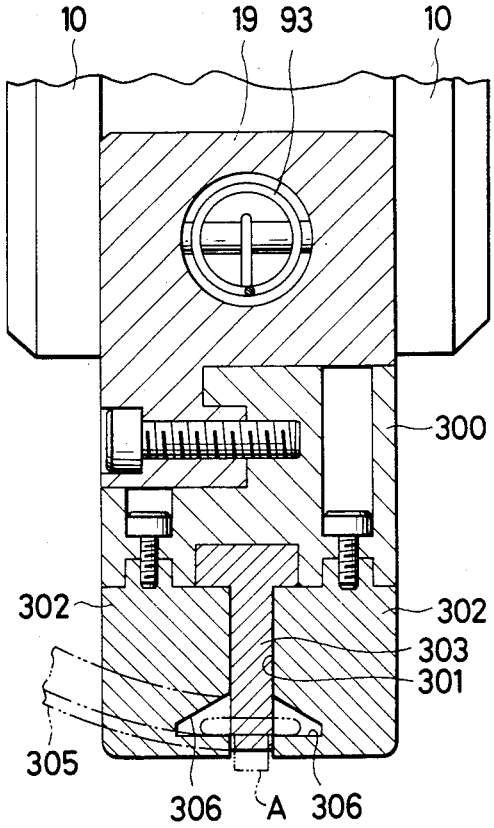
FIG. 5 is an enlarged cross-sectional view taken along line IV—IV of FIG. 2, showing a forward end portion of the first pusher mechanism.

As shown in FIGS. 2 and 5, the first pusher mechanism 3 includes a first elongated guide base 300 secured to the under side of the support 19, and a pair of parallel guide plates 302, 302 secured to the under side of the guide base 300. The first guide base 300 and the two guide plates 302, 302 jointly define a longitudinal guide channel 301 of a T-shaped cross section, in which a first elongated pusher 303 of a T-shaped cross section is slidably received. The two guide plates 302, 302 have in their inner surfaces a pair of grooves 306, 306 (FIG. 5) for guiding the head portion of a button A. A first chute 305 (FIGS. 1, 2, 5), for delivering the successive buttons A to the first pusher mechanism 3, has.a lower end portion extending through the left guide plate 302 and communicates with the left groove 304 at the junction 324 (FIG. 2).

A succession of the buttons A is delivered from the first feeder 4 to the junction 324 (FIG. 2) via the first chute 305. While the forward end of the first pusher 303 is disposed forwardly (rightwardly) of the junction 324, a leading one of the successive buttons A which has reached 1. the junction 324 is prevented from entering the groove 306. When the forward end of the pusher 303 is disposed behind the junction 324 as the pusher 303 is fully retracted, the leading button A slides into the groove 306 in front of the pusher's forward end. Then the leading button A is pushed forwardly along the groove 306 by the pusher 303 as the latter is moved forwardly, during which time entering of the succeeding buttons A into the junction 324 is prevented by the projected pusher 303. Thus the successive buttons A are supplied one at a time to the upper unit 1.

Figure 6:
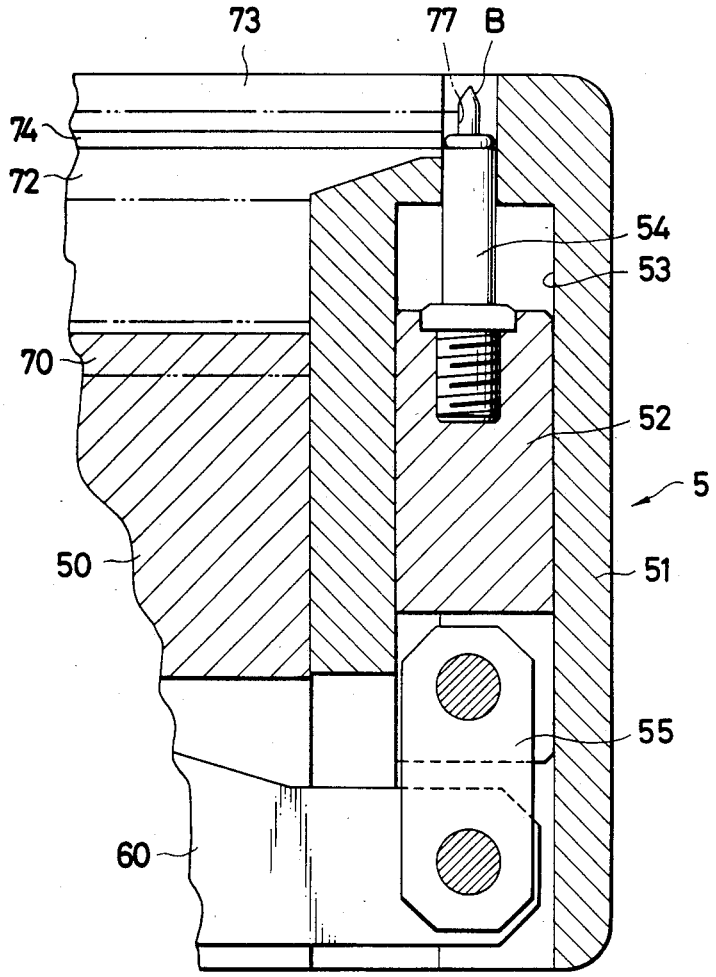
FIG. 6 is a fragmentary enlarged cross-sectional view of FIG. 1, showing a lower unit.

As shown in FIGS. 1 and 6, the lower unit 5 includes a base 50 fixedly supported by the frame 10, a second support block 51 fixed to the base 50, and a lower plunger 52 reciprocable vertically within a third vertical channel 53 in the support block 51. A die 54 is fixed to the upper end of the lower plunger 52. The lower plunger 52 is operatively connected to the second drive mechanism 6.

The second drive mechanism 6 includes a third lever 60 pivotally supported on the frame 10 by means of a pin 65, a second air cylinder 61 fixed to the frame 10, a shock absorber 63 disposed between a piston rod 62 of the second air cylinder 61 and a roller 66 rotatably mounted on one end of the third lever 60. The other end of the third lever 60 is connected to the lower end of the lower plunger 52 via a link 55. The third lever 60 is normally urged by a pair of compression springs 64, 64 to pivot clockwise in such a manner that the roller 66 on the left end of the third lever 60 pushes the piston rod 62 of the second air cylinder 61 upwardly to its retracted position via the shock absorber 63 and also in such a manner that the right end of the third lever 60 pulls the lower plunger 52 and thus the die 54 to its lowered position via the link 55. When the piston rod 62 of the second air cylinder 61 is actuated to push the roller 66 on the left end of the third lever 60 downwardly via the shock absorber 63, the third lever 60 is pivotally moved counterclockwise to raise the lower plunger 52 and the die 54.

Figure 7:
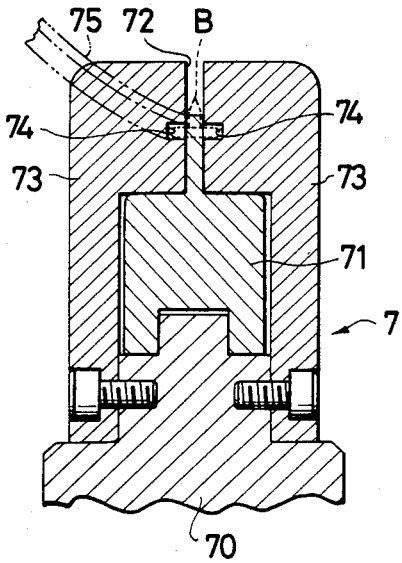
FIG. 7, appearing with FIG. 3, is an enlarged cross-sectional view taken along line VII—VII of FIG. 1.

As shown in FIGS. 1, 6 and 7, the second pusher mechanism 7 includes a second elongated guide base 70 fixedly supported by the frame 10, a pair of parallel guide plates 73, 73 secured to the upper side of the guide base 70 so as to define therebetween a longitudinal guide channel 72, and a second elongated pusher 71 slidably received in the guide channel 72. The two guides plates 73, 73 have in their inner surfaces a pair of grooves 74, 74 for guiding the head portion of a tack B.

A second chute 75 (FIGS. 1 and 7), for delivering the successive tacks B to the second pusher mechanism 7, has a lower end portion extending through one of the guide plates 73 and communicates with the corresponding groove 74 at the junction 76 (FIG. 1).

The second pusher 71 has a pushing surface 77; in response to the reciprocating movement of the second pusher 71, the pusher surface 77 is moved between a rear position behind the junction 76 and a forward position in which a tack B is placed onto the die 54.

The first pusher mechanism 3 and the second pusher mechanism 7 are driven in timed relation to each other by the third drive mechanism 9. As shown in FIGS. 1 and 2, the third drive mechanism 9 includes a fourth lever 91 having an upper end pivotally supported on the frame 10 by means of a pin 90, a third air cylinder 92 fixed to the support 19 for causing the fourth lever 91 to pivot, an extension spring 93 acting between the support 19 and the fourth lever 91 to normally urge the latter toward the third air cylinder 92, and a pushing block 95 connected to a lower end of the fourth lever 91 via a link 94. The first pusher 303 of the first pusher mechanism 3 is connected to the pushing block 95 by a first connector 96, while the second pusher 71 of the second pusher mechanism 7 is connected to the pushing block 95 by a second corresponding connector (not shown).

The piston rod 98 of the third air cylinder 92 is normally retracted so that the first and second pushers 303, 71 normally assume their advanced position under the bias of the extension spring 93. Then as the piston rod 98 of the third air cylinder 92 is extended, the fourth lever 91 pivots clockwise in FIG. 1 about the pin 90 to cause the first and second pushers 303, 71 to be moved to their retracted position, thus allowing a succeeding button A and a succeeding tack B to be delivered into the guide channels 306, 72 in front of the first and second pushers 303, 71, respectively.

With the piston rods 22, 62, 98 of the first, second and third air cylinders 20, 61, 92 retracted, with the retraction of third air cylinder 92, the fourth lever 91 pivots counterclockwise (FIG. 1) to cause the first and second pushers 303, 71 to be moved to their advanced position. During that time, the first pusher 303 pushes a button A forwardly through the guide channel 306 until the button A is clamped between the clamp members 122, 122 (FIGS. 1 and 4) in the upper unit 1, while the second pusher 71 pushes a tack B forwardly through the guide channel 72 until the tack B is placed on the die 54 in the lower unit 5.

As shown in FIGS. 1 and 2, the first and second levers 23, 24 of the toggle joint 21 assume a dogleg shape as the piston rod 22 of the air cylinder 20 is retracted. When the first air cylinder 20 is energized, the first and second levers 23, 24 begin to become vertically aligned, thus causing the upper plunger 105 to be moved downwardly against the bias of the compression spring 115. The punch 105 is thereby moved downwardly so that its lower end is brought into contact with a button A clamped between the clamp members 122, 122 in vertical alignment with a tack B placed on the die 54.

Figure 3:
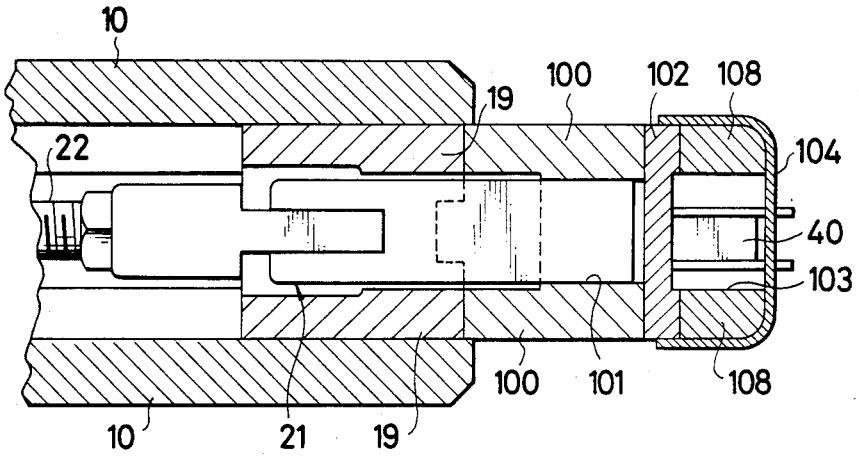
FIG. 3 is an enlarged cross-sectional view taken along line III—III of FIG. 2.
Figure 4:
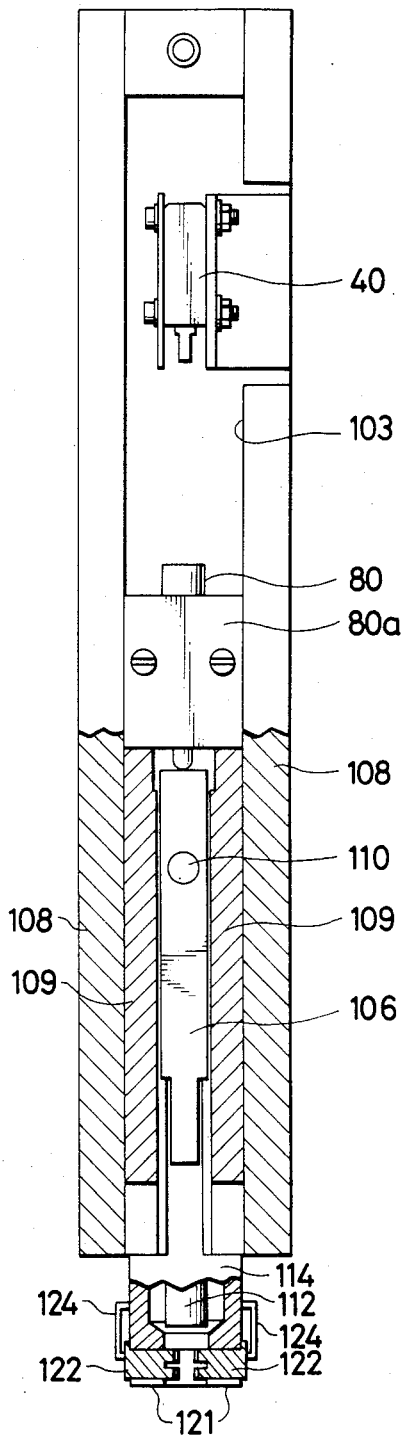
FIG. 4 is a fragmentary enlarged front elevational view, partly in cross section, of FIG. 1, showing the upper unit.

With continued extension of the toggle joint 21, as shown in FIGS. 2 and 3, the upper plunger 105 and thus the slide 106 are lowered with the hook portion 117 of the slide 106 engaging the projection 116 of the support block 114. With the projection 116 engaged by the support block's hook portion 117, the support block 114 continues to be moved downwardly together with the slide 106.

This lowering of the upper plunger 105 continues until the toggle joint 21 becomes fully extended, i.e. the first and second levers 23, 24 are vertically lined up, at which time the lower end surfaces of the clamp members 122, 122 are in contact with a garment fabric C (FIG. 1) placed over the tack B.

Upon the full extension of the toggle joint 21, the contact member 42, which is mounted on the edge of the first lever 23, depresses the actuator 41 of the limit switch 40 to actuate the latter so that the first air cylinder 20 is temporarily de-energized and remains in this position. Subsequently, as the second air cylinder 61 is energized, the piston rod 62 projects to downwardly push the roller 66 on the rear end of the third lever 60 via the shock absorber 63, thus causing the third lever 60 to pivot counterclockwise in FIG. 1. The lower plunger 52 and thus the die 54 is thereby moved upwardly, with the tack B placed on the die 54 (with the spike 16 directed upwardly). As a result, the spike 16 of the tack B pierces through the garment fabric C and is then inserted through the shank 12 of the button A, and the distal end of the spike 16 is finally deformed so as to join the tack B and the button A together, thus attaching the latter to the garment fabric C.

Upon completion of the attaching operation of the button A, the piston rods 22, 62, 98 of the first, second and third air cylinders 20, 61, 92 are returned to their original positions in timed relation to one another so that the punch 112 and the die 54 are retracted away from each other. Thereafter, the first and second pushers 303, 71 is moved forwardly to supply a succeeding button A and a succeeding tack B to the upper unit 1 and the lower unit 2, respectively, for a subsequent attaching operation.

Since extension of the piston rod 22 of the air cylinder 20 is not terminated until the limit switch 40 is actuated by the contact member 42 to produce an electrical signal to de-energize the air cylinder 20, that is, until the toggle joint 21 is fully extended to a predetermined extent, the punch 112 can be lowered to a predetermined level reliably so that a button A and a mating tack B are compressed between the punch 112 and the die 54 sufficiently.

Although various minor modifications may be suggested by those versed in the art, it should be understood that I wish to embody within the scope of the patent warranted thereon, all such embodiments as reasonably and properly come within the scope of my contribution to the art.

What is claimed is:

1. An apparatus for assembling a pair of fastener elements of a garment fastener, comprising:

(a) a frame;

(b) a pair of vertically aligned upper and lower units supported by said frame for receiving the respective fastener elements, said lower unit having a die, said upper unit including an upper plunger reciprocably supported by said frame and having a punch movable, in response to reciprocating movements of said upper plunger, toward and away from said die to join the two fastener elements together;

(c) a drive mechanism operatively connected to said upper plunger for vertical reciprocating movements, said drive mechanism including an air cylinder having a piston rod, and a toggle joint extending between one end of said piston rod and an upper end of said upper plunger, said toggle joint including a pair of mutually pivotally interconnectd levers and being movable, in response to extension and retraction of said piston rod of said air cylinder, between a contracted position in which said levers are angled with respect to each other, and an extended position in which said levers are substantially vertically aligned with each other; and (d) means for detecting said extended position of said toggle joint and for terminating the extension of said piston rod in response to said detection, said detecting means including: a limit switch mounted on said frame and having an actuator; and a contact member mounted on an edge of one of said levers and engageable, when said one lever assumes a substantially vertical posture, with said actuator of said limit switch to actuate the latter to produce an electrical signal for de-energizing said air cylinder.

2. An apparatus according to claim 1, said contact member being a screw threadedly mounted on said one lever so as to project from the edge of said one lever.

* * * * *